US006866502B2

(12) United States Patent
Stephens

(10) Patent No.: US 6,866,502 B2
(45) Date of Patent: Mar. 15, 2005

(54) BURNER SYSTEM EMPLOYING FLUE GAS RECIRCULATION

(75) Inventor: George Stephens, Humble, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 10/389,599

(22) Filed: Mar. 14, 2003

(65) Prior Publication Data

US 2003/0175645 A1 Sep. 18, 2003

Related U.S. Application Data

(60) Provisional application No. 60/365,138, filed on Mar. 16, 2002.

(51) Int. Cl.[7] ..... F23M 3/00

(52) U.S. Cl. ..... 431/9; 431/5; 126/91 A

(58) Field of Search ..... 431/9, 5, 115, 431/215; 126/91 A

(56) References Cited

U.S. PATENT DOCUMENTS

| | | |
|---|---|---|
| 2,368,370 A | 1/1945 | Maxon |
| 2,813,578 A | 11/1957 | Ferguson |
| 2,918,117 A | 12/1959 | Griffin |

(List continued on next page.)

FOREIGN PATENT DOCUMENTS

| | | | |
|---|---|---|---|
| CA | 1169753 | 6/1984 | ..... F23D/17/00 |
| DE | 2944153 | 5/1981 | |
| DE | 3232421 | 3/1984 | |
| DE | 3818265 | 11/1989 | |
| EP | 0099828 | 6/1988 | |
| EP | 0 347 956 | 12/1989 | ..... F23D/14/22 |
| EP | 0 374 423 | 6/1990 | |
| EP | 0 408 171 A1 | 1/1991 | ..... F23D/21/00 |
| EP | 0 507 233 | 10/1992 | |
| EP | 0 620 402 A1 | 10/1994 | ..... F23R/3/10 |

(List continued on next page.)

OTHER PUBLICATIONS

Abstract of EP 0 507 233 published on Oct. 7, 1992, entitled "Burner for Liquid Fuels".

Chemical Engineering Progress, vol. 43, 1947, "The Design of Jet Pumps" by A. Edgar Kroll, pp. 21–24, vol. 1, No. 2.

Straitz III, John F., et al., "Combat NOx With Better Burner Design," *Chemical Engineering*, Nov. 1994, pp. EE–4–EE–8.

(List continued on next page.)

*Primary Examiner*—Alfred Basichas
(74) *Attorney, Agent, or Firm*—Lucinda Lomas; Linda A. Kubena

(57) ABSTRACT

System for reducing $NO_x$ emissions from burners of furnaces such as those used in steam cracking. The system includes a furnace having at least one burner, the at least one burner including a primary air chamber; a burner tube including a downstream end, an upstream end in fluid communication with the primary air chamber for receiving air, flue gas or mixtures thereof and fuel, a venturi portion positioned between the downstream end and the upstream end, and a burner tip mounted on the downstream end of the burner tube adjacent the first opening in the furnace for combusting the fuel downstream of the burner tip; and a fuel orifice located adjacent the upstream end of the burner tube for introducing fuel into the burner tube; a source of flue gas, said source positioned so as to enable the flue gas to achieve a temperature of less than 2000° F. at least one passageway for conducting flue gas from the source to the primary air chamber; and inspirating means, the inspirating means including the venturi portion effective for drawing flue gas from the source, through the at least one passageway and the primary air chamber in response to an inspirating effect of uncombusted fuel exiting the fuel orifice, the uncombusted fuel flowing through the burner tube from its upstream end towards its downstream end, whereby the flue gas is mixed with air at the upstream end of the burner tube prior to the zone of combustion of the fuel.

36 Claims, 6 Drawing Sheets

U.S. PATENT DOCUMENTS

| | | | | | |
|---|---|---|---|---|---|
| 2,983,312 | A | | 5/1961 | Finley et al. | |
| 3,880,570 | A | | 4/1975 | Marshall | |
| 4,004,875 | A | | 1/1977 | Zink et al. | |
| 4,089,629 | A | | 5/1978 | Baumgartner et al. | |
| 4,130,388 | A | | 12/1978 | Flanagan | |
| 4,230,445 | A | | 10/1980 | Janssen | |
| 4,257,763 | A | | 3/1981 | Reed | |
| 4,575,332 | A | | 3/1986 | Oppenberg et al. | |
| 4,629,413 | A | | 12/1986 | Michelson et al. | |
| 4,708,638 | A | | 11/1987 | Brazier et al. | |
| 4,739,713 | A | | 4/1988 | Vier et al. | |
| 4,748,919 | A | | 6/1988 | Campobenedetto et al. | |
| 4,815,966 | A | | 3/1989 | Janssen | |
| 4,828,483 | A | | 5/1989 | Finke | |
| 4,963,089 | A | | 10/1990 | Spielman | |
| 4,995,807 | A | | 2/1991 | Rampley et al. | |
| 5,044,931 | A | | 9/1991 | Van Eerden et al. | |
| 5,073,105 | A | | 12/1991 | Martin et al. | |
| 5,092,761 | A | | 3/1992 | Dinicolantonio | |
| 5,098,282 | A | | 3/1992 | Schwartz et al. | |
| 5,135,387 | A | | 8/1992 | Martin et al. | |
| 5,152,463 | A | | 10/1992 | Mao et al. | |
| 5,154,596 | A | | 10/1992 | Schwartz et al. | |
| 5,195,884 | A | | 3/1993 | Schwartz et al. | |
| 5,201,650 | A | | 4/1993 | Johnson | |
| 5,224,851 | A | | 7/1993 | Johnson | |
| 5,238,395 | A | | 8/1993 | Schwartz et al. | |
| 5,254,325 | A | * | 10/1993 | Yamasaki et al. | 423/450 |
| 5,263,849 | A | | 11/1993 | Irwin et al. | |
| 5,269,679 | A | | 12/1993 | Syska et al. | |
| 5,275,554 | A | | 1/1994 | Faulkner | |
| 5,284,438 | A | | 2/1994 | McGill et al. | |
| 5,299,930 | A | | 4/1994 | Weidman | |
| 5,316,469 | A | | 5/1994 | Martin et al. | |
| 5,326,254 | A | | 7/1994 | Munk | |
| 5,344,307 | A | | 9/1994 | Schwartz et al. | |
| 5,350,293 | A | | 9/1994 | Khinkis et al. | |
| 5,370,526 | A | | 12/1994 | Buschulte et al. | |
| 5,407,345 | A | | 4/1995 | Robertson et al. | |
| 5,413,477 | A | | 5/1995 | Moreland | |
| 5,470,224 | A | | 11/1995 | Bortz | |
| 5,472,341 | A | | 12/1995 | Meeks | |
| 5,542,839 | A | | 8/1996 | Kelly | |
| 5,562,438 | A | | 10/1996 | Gordon et al. | |
| 5,584,684 | A | | 12/1996 | Dobbeling et al. | |
| 5,603,906 | A | | 2/1997 | Lang et al. | |
| 5,611,682 | A | | 3/1997 | Slavejkov et al. | |
| 5,624,253 | A | | 4/1997 | Sulzhik et al. | |
| 5,685,707 | A | | 11/1997 | Ramsdell et al. | |
| 5,688,115 | A | * | 11/1997 | Johnson | 431/9 |
| 5,807,094 | A | | 9/1998 | Sarv | |
| 5,813,846 | A | * | 9/1998 | Newby et al. | 431/9 |
| 5,980,243 | A | | 11/1999 | Surbey et al. | |
| 5,984,665 | A | | 11/1999 | Loftus et al. | |
| 5,987,875 | A | | 11/1999 | Hillburn et al. | |
| 5,993,193 | A | | 11/1999 | Loftus et al. | |
| 6,007,325 | A | | 12/1999 | Loftus et al. | |
| 6,056,538 | A | | 5/2000 | Büchner et al. | |
| 6,332,408 | B2 | | 12/2001 | Howlett et al. | |
| 6,347,935 | B1 | | 2/2002 | Schindler et al. | |
| 6,383,462 | B1 | | 5/2002 | Lang | |
| 6,616,442 | B2 | | 9/2003 | Venizelos et al. | |

FOREIGN PATENT DOCUMENTS

| | | | |
|---|---|---|---|
| EP | 0 674 135 B2 | 9/1995 | F23D/14/24 |
| EP | 0 751 343 | 1/1997 | |
| EP | 0486169 | 1/1998 | |
| EP | 1096202 | 2/2001 | |
| EP | 1 211 458 | 6/2002 | |
| FR | 2629900 | 10/1988 | |
| RU | 374488 | 3/1973 | |

OTHER PUBLICATIONS

Vahdati, M. M., et al., "Design And Development of A Low NOx Coanda Ejector Burner," *Journal of the Institute of Energy*, Mar. 2000, vol. 73, pp. 12–17.

Bussman, Wes, et al., "Low NOx Burner Technology for Ethylene Cracking Furnaces," presented at the *2001 AIChE Spring National Meeting, 13th Annual Ethylene Producers Conference*, Houston, TX, Apr. 25, 2001, pp. 1–23.

Seebold, James G., "Reduce Heater NOx in the Burner," *Hydrocarbon Processing*, Nov. 1982, pp. 183–186.

"West Germany's Caloric Develops a Low–NOx Recycling Fuel Burner," *Chemical Engineering*, Oct. 4, 1982, p. 17.

* cited by examiner

BURNER SYSTEM EMPLOYING FLUE GAS RECIRCULATION

RELATED APPLICATIONS

This patent application claims priority from Provisional Application Ser. No. 60/365,138, filed on Mar. 16, 2002, the contents of which are hereby incorporated by reference.

FIELD OF THE INVENTION

This invention relates to an improvement in a burner system such as those employed in high temperature furnaces in the steam cracking of hydrocarbons. More particularly, it relates to a system employing flue gas recirculation (FGR) to achieve a reduction in $NO_x$ emissions.

BACKGROUND OF THE INVENTION

As a result of the interest in recent years to reduce the emission of pollutants from burners used in large furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations. In recent years, a wide variety of mobile and stationary sources of $NO_x$ emissions have come under increased scrutiny and regulation.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

In gas fired industrial furnaces $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

One technique for reducing $NO_x$ that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Staging results in reducing peak temperatures in the primary flame zone and has been found to alter combustion speed in a way that reduces $NO_x$. Since $NO_x$ formation is exponentially dependent on gas temperature, even small reductions in peak flame temperature can dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

Thus, one set of techniques achieves lower flame temperatures by using staged-air or staged-fuel burners to lower flame temperatures by carrying out the initial combustion at far from stoichiometric conditions (either fuel-rich or air-rich) and adding the remaining air or fuel only after the flame has radiated some heat away to the fluid being heated in the furnace.

Another set of techniques achieves lower flame temperatures by diluting the fuel-air mixture with inert material. Flue-gas (the products of the combustion reaction) or steam are commonly used diluents. Such burners are classified as FGR (flue-gas-recirculation) or steam-injected, respectively.

U.S. Pat. No. 5,092,761 discloses a method and apparatus for reducing $NO_x$ emissions from premix burners by recirculating flue gas. Flue gas is drawn from the furnace through a pipe or pipes by the inspirating effect of fuel gas. The flue gas mixes with combustion air in a primary air chamber prior to combustion to dilute the concentration of $O_2$ in the combustion air, which lowers flame temperature and thereby reduces $NO_x$ emissions. While burners of this type offer the advantage of supplying recycled flue gas without the need of an external fan, saving the expense of the fan and its energy consumption, flue gas drawn from the burner's radiant box is generally in the range of 1000 to 2000° F., while flue gas drawn from the furnace exhaust is generally less than 700° F. Flue gas drawn from a furnace exhaust also offers the advantage of having lower $O_2$ content (about 1–3% vs. 5–15%), enhancing its ability to serve as a diluent.

In certain premix burners, including those disclosed in U.S. Pat. No. 5,092,761, a centering plate is utilized to assure maximum entrainment. The contents of U.S. Pat. No. 5,092,761 are incorporated herein by reference.

Analysis of burners of the type described in U.S. Pat. No. 5,092,761 has indicated the flue-gas-recirculation (FGR) ratio is generally in the range 5–10% where FGR ratio is defined as:

$$\text{FGR ratio } (\%)=100[G/(F+A)]$$

where G=Flue-gas drawn into venturi, (lb)
F=Fuel combusted in burner, (lb), and
A=Air drawn into burner, (lb).

The ability of these burners to generate higher FGR ratios is limited by the inspirating capacity of the gas spud/venturi/FGR flow ducting combination. Further closing of the primary air dampers will produce lower pressures in the primary air chamber and thus enable increased FGR ratios. However, the flow of primary air may be reduced such that insufficient oxygen exists in the venturi for acceptable burner stability.

European Application No. 1,096,202 A1 proposes fuel dilution methods and an apparatus aimed at $NO_x$ reduction. Proposed in this application is a method which includes providing a chamber outside of the burner and furnace for mixing flue gases from the furnace with fuel gas, discharging the fuel gas in the form of a fuel jet into the mixing chamber so that flue gases from the furnace are drawn into the chamber and mixed with and dilute the fuel gas therein and conducting the resulting mixture of flue gases and fuel gas to the burner wherein the mixture is combined with the combustion air and burned in the furnace. The flue gas is shown to be drawn from a furnace exhaust duct.

Disadvantages associated with the proposal of European Application No. 1,096,202 A1 include the fact that fuel gas is introduced outside of the burner and furnace in a separate chamber, an arrangement that could pose leakage problems. In addition, it is a less than an optimal arrangement to pass a potentially explosive mixture through an external duct associated with the furnace. Another disadvantage is the apparent difficulty of retrofitting the proposal to existing burners. Finally, while steam is used in connection with the teachings of European Application No. 1,096,202 A1, it is only used for the purpose of reducing $NO_x$ and not for increasing the available motive force to transport flue gas into the burner.

Despite these advances in the art, a need exists for a burner capable of utilizing flue gas for recirculating, drawn from a furnace exhaust stack, which does not require, or minimizes the need for, the use of an external fan.

Therefore, what is needed is a burner for the combustion of fuel gas and air, which better enables the use of cooler, lower oxygen content, flue gas for recirculating, permitting higher FGR recirculation ratios to be utilized, yielding further reductions in $NO_x$ emissions.

SUMMARY OF THE INVENTION

The present invention is directed to a method and system for reducing $NO_x$ emissions from burners of furnaces such as those used in steam cracking. The system includes a furnace including, a burner, the burner including a primary air chamber; a burner tube having a downstream end, an upstream end in fluid communication with the primary air chamber for receiving air, fuel gas or mixtures thereof and fuel and optionally steam, a venturi portion positioned between the downstream end and the upstream end, and a burner tip mounted on the downstream end of the burner tube for combusting the fuel downstream of the burner tip; and a fuel orifice located adjacent the upstream end of the burner tube for introducing fuel into the burner tube; a source of flue gas, the source positioned so as to enable the flue gas to achieve a temperature of less than 2000° F., at least one passageway for conducting flue gas from the source to the primary air chamber; and inspirating means, the inspirating means including the venturi portion for drawing flue gas from the source, through the at least one passageway and the primary air chamber in response to an inspirating effect of uncombusted fuel exiting the fuel orifice, the uncombusted fuel flowing through the burner tube from its upstream end towards its downstream end, whereby the flue gas is mixed with air at the upstream end of the burner tube prior to the zone of combustion of the fuel. The system may additionally have means for injecting steam.

In accordance with a specific aspect of the invention, the passageway is located exteriorly of the burner. In one embodiment of the invention the source is an exhaust of the furnace.

In accordance with another broad aspect of the present invention, a method for reducing $NO_x$ emissions in a burner having a fuel orifice is provided. The method includes the steps of providing a source of flue gas, the source positioned so as to enable the flue gas to achieve a temperature of less than 2000° F. combining fuel and air, flue gas or mixtures thereof at a predetermined location adjacent a venturi, passing the combined fuel and air, flue gas or mixtures thereof through the venturi; and combusting the fuel at a combustion zone downstream of the venturi, whereby the inspirating effect of the uncombusted fuel exiting the fuel orifice and flowing through the venturi draws flue gas from the source through a passageway to the predetermined location.

An object of the present invention is to provide a burner arrangement that permits low temperature furnace exhaust flue gas to be drawn into the burner tube venturi by natural inspiration, without the need for externally powered fans or other means, reducing $NO_x$ emissions.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE PREFERRED EMBODIMENTS

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Figure 1:
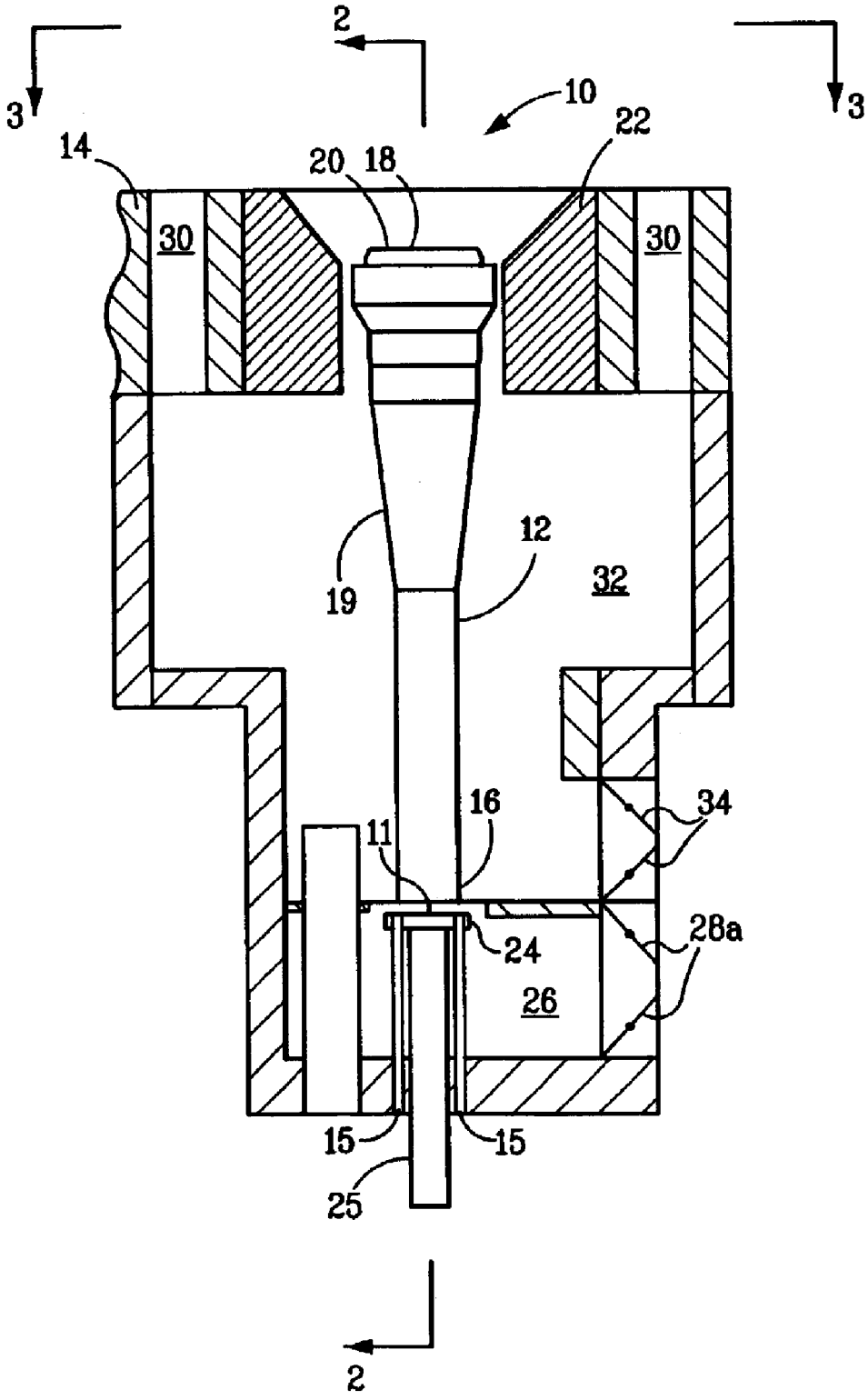
FIG. 1 illustrates an elevation partly in section of an embodiment of the premix burner system of the present invention.
Figure 3:
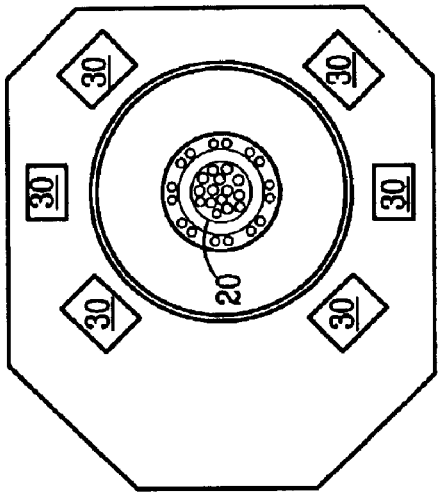
FIG. 3 is a plan view taken along line 3—3 of FIG. 1.
Figure 2:
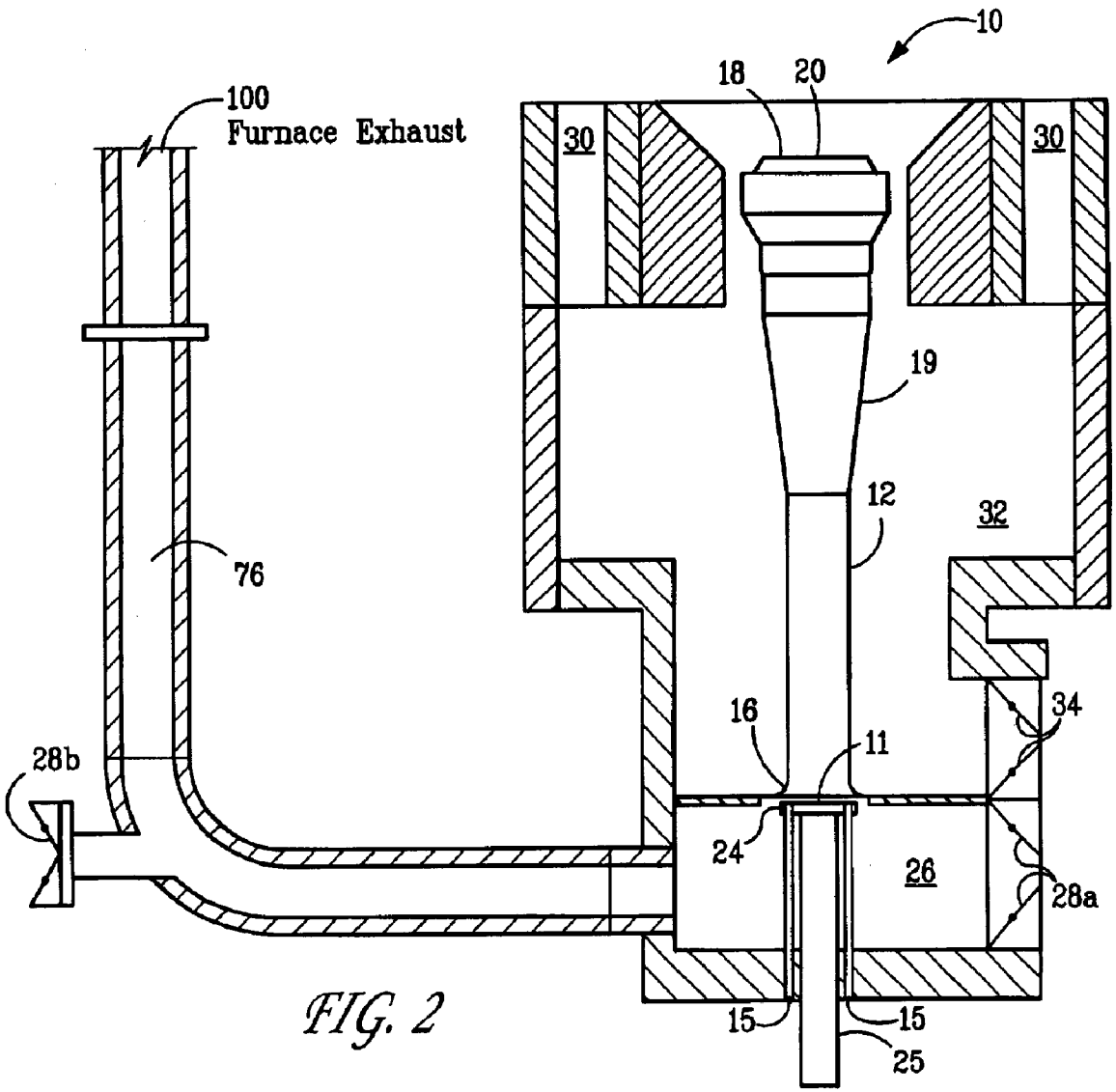
FIG. 2 is an elevation partly in section taken along line 2—2 of FIG. 1.

Referring particularly to FIGS. 1–3, a premix burner 10 includes a freestanding burner tube 12 located in a well in a floor 14 of a furnace. The burner tube 12 includes an upstream end 16, a downstream end 18 and a venturi portion 19. A burner tip 20 is located at the downstream end 18 and is surrounded by an annular tile 22. A fuel orifice 11, which may be located within gas spud 24, is at the top end of a gas fuel riser 25 and is located at the upstream end 16 and introduces fuel gas into the burner tube 12. Fresh or ambient air is introduced into a primary air chamber 26 through an adjustable damper 28(*a*) and/or 28(*b*) to mix with the fuel gas at the upstream end 16 of the burner tube 12 and pass upwardly through the venturi portion 19. Combustion of the fuel gas and fresh air occurs downstream of the burner tip 20. As may be appreciated, a motive force is provided by the flow of fuel gas into venturi portion 19, inducing the flow of flue gas, air or mixtures thereof and optionally steam into the burner tube 12.

A plurality of air ports 30 originate in a secondary air chamber 32 and pass through the furnace floor 14 into the furnace. Fresh or ambient air enters the secondary air chamber 32 through adjustable damper 34 and passes through the staged air ports 30 into the furnace to provide secondary or staged combustion, as described in U.S. Pat. No. 4,629,413, which is hereby incorporated herein by reference.

As preferred, flue gas having a temperature less than about 700° F. is drawn from furnace exhaust 100 through recirculation (FGR) duct 76 into a primary air chamber 26 by the inspirating effect of the fuel gas passing through the venturi portion 19. Drawing flue gas from the exhaust stream rather than directly from the furnace box adjacent the burner flame provides a lower temperature flue gas, thereby substantially increasing the effectiveness of the flue gas to lower flame temperature, which results in reduced $NO_x$ emission.

Flue gas containing, for example, about 2% $O_2$ is drawn from the furnace exhaust through the duct 76 by the inspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. This is in contrast to a liquid fuel burner, such as that of U.S. Pat. No. 2,813,578, in which the combustion air is mixed with the fuel at the zone of combustion, rather than prior to the zone of combustion.

Closing or partially closing damper 28(*a*) and/or 28(*b*) restricts the amount of fresh air that can be drawn into the primary air chamber 26 and thereby provides the vacuum necessary to draw flue gas from the furnace exhaust.

Thus, it can be seen that, by use of this invention, $NO_x$ emissions may be reduced in a premix burner without the use of fans or special burners. The flue gas recirculation system of the present invention can also easily be retrofitted to existing premix burners because the motive force from the fuel flowing through the venturi serves to minimize or eliminate the need for the installation of an external fan when retrofitting.

A further advantage over systems drawing flue gas from the radiant box of the furnace lies in the fact that externally drawn FGR typically has a lower oxygen content. Flue gas sourced externally from the furnace exhaust stack will typical have a 2–3 volume % $O_2$ content. By comparison, it has been found that flue gas recirculated from the base of the burner flame has a typical $O_2$ content of about 10–15 volume %. Recirculated flue gas with a lower $O_2$ content is a more effective diluent for reducing $NO_x$ because it is less reactive, i.e., more inert.

In addition to the use of flue gas as a diluent, another technique to achieve lower flame temperature through dilution is through the use of steam injection, which also advantageously increases the motive force available for inducing external FGR, when injected into the primary air chamber upstream of the venturi 19 of the burner tube 12. For $NO_x$ reduction purposes, alone, steam can also be injected into the secondary air chamber. Preferably, steam may be injected upstream of the venturi through injection tube(s) 15.

Figure 4:
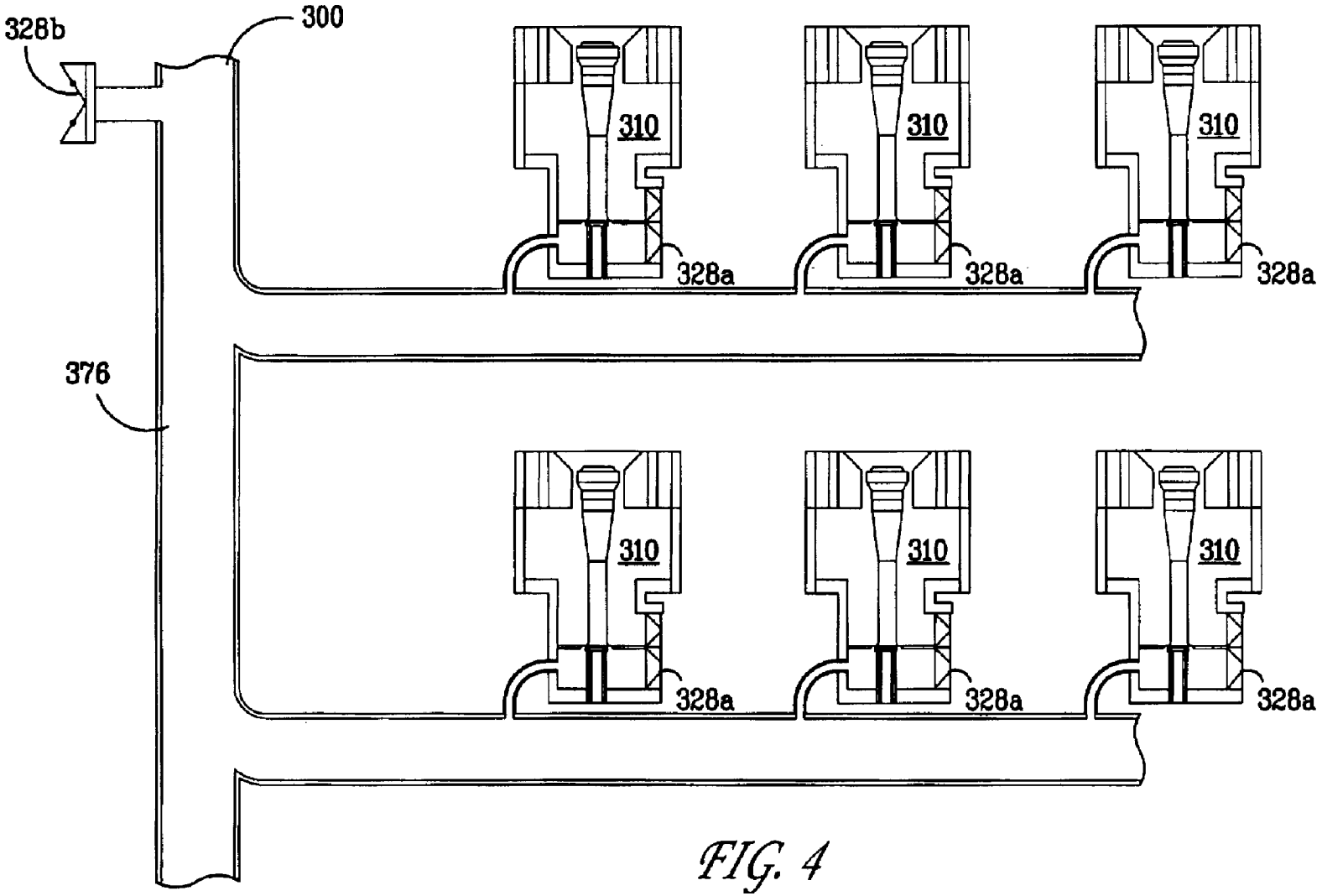
FIG. 4 is a schematic illustration of an embodiment of the present invention employing multiple burners in series and sharing an external exhaust.

FIG. 4 is a schematic illustration of the present invention wherein multiple burners 310 of the types described herein are included in a furnace and share the same FGR duct 376 and exhaust 300. While FIG. 4 shows three burners 310 in series, any number of burners, whether more or less, may be used and remain within the spirit and scope of the present invention. As shown, primary air may be admitted to burners 310 through primary dampers 328*a*, through damper(s) 328*b* or through a combination of primary dampers 328*a* and damper(s) 328*b*.

Figure 5:
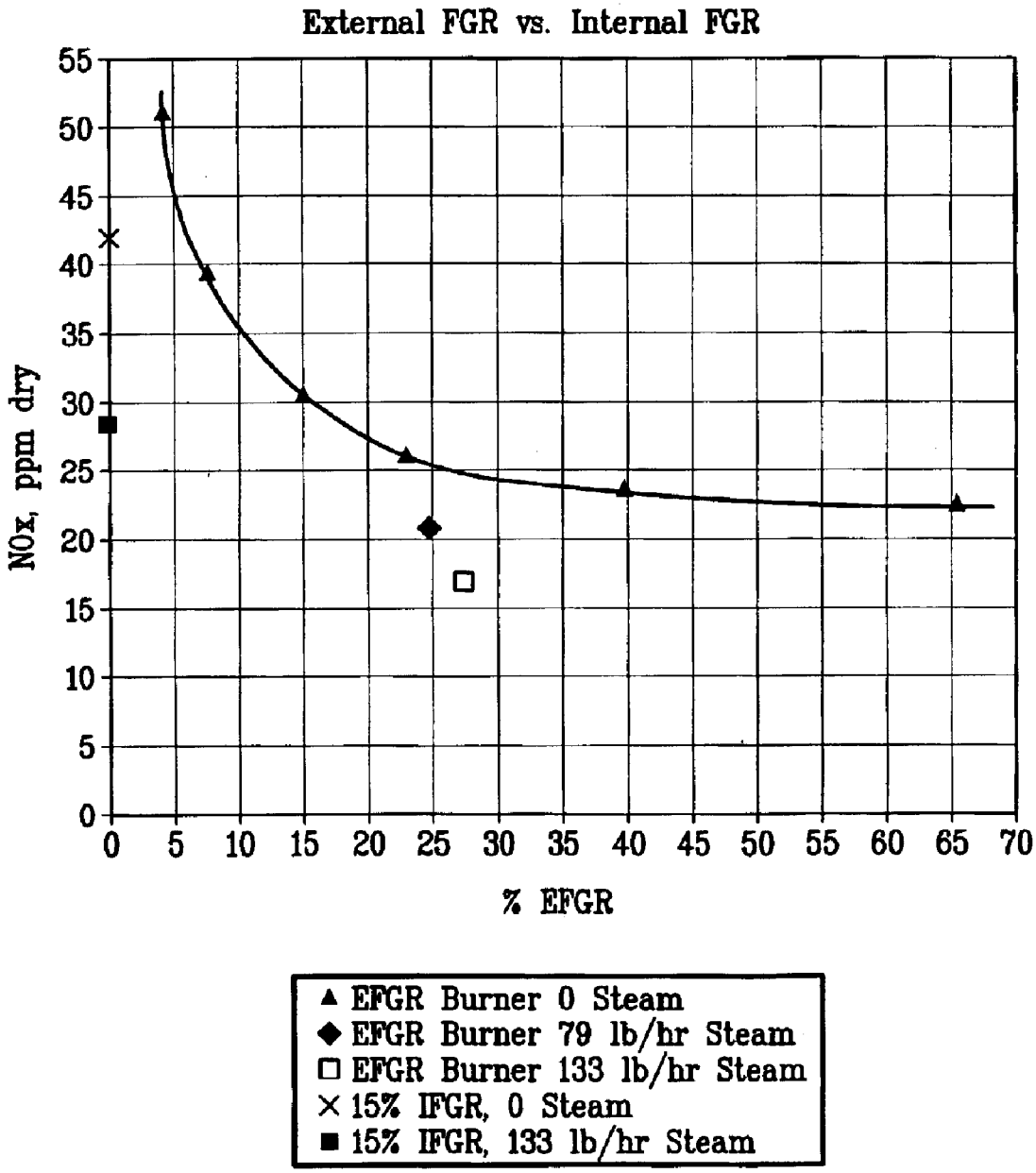
FIG. 5 is a plot of $NO_x$ emissions as a function of external FGR, in percent.

FIG. 5 presents a plot of $NO_x$ emissions as a function of external flue gas recirculation level, with varying levels of steam injection. As shown, these results are compared with results obtained using about 15% internal FGR. This figure demonstrates the benefits of the present invention.

Figure 6:
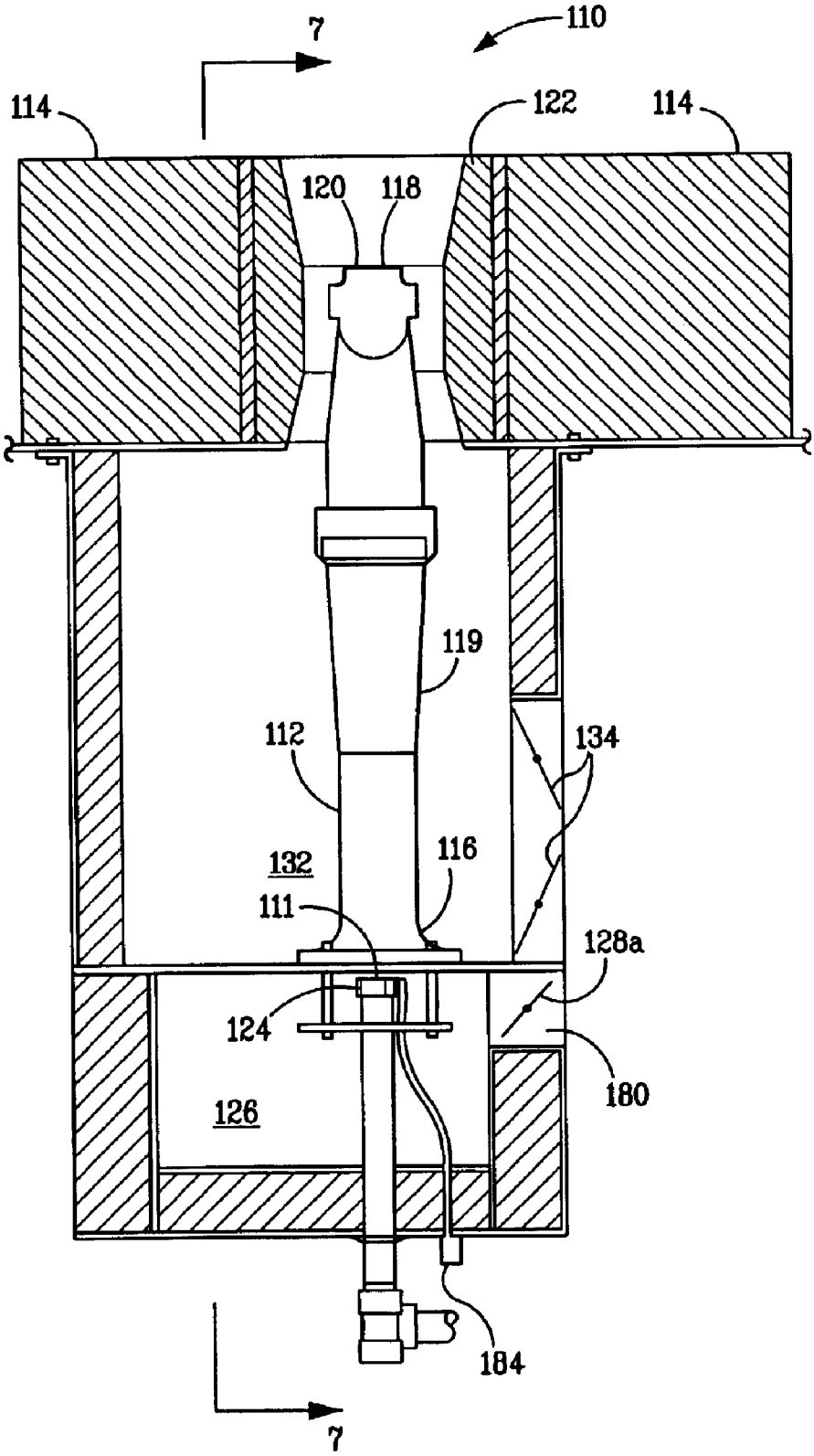
FIG. 6 illustrates an elevation partly in section of an embodiment of a flat-flame burner of the present invention.
Figure 7:
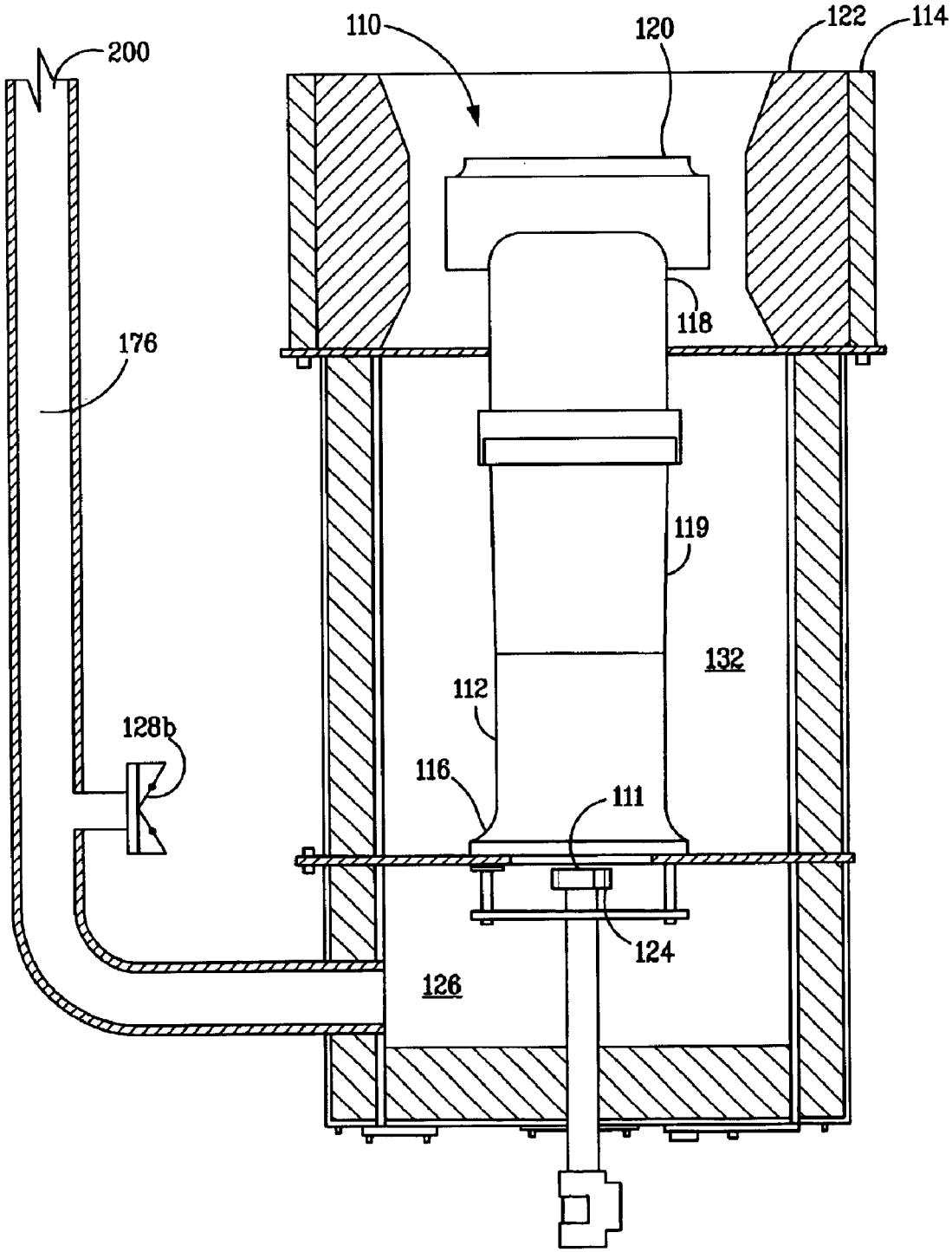
FIG. 7 is an elevation partly in section of the embodiment of a flat-flame burner of FIG. 6 taken along line 7—7 of FIG. 6.

The flue gas recirculation teachings disclosed herein can alternatively be applied in flat-flame burners, as will now be described by reference to FIGS. 6 and 7.

A burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124, is located at upstream end 116 and introduces fuel gas into burner tube 112. Fresh or ambient air may be introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, an external flue gas recirculation passageway 176 drawn from furnace exhaust 200 is connected to primary air chamber 126, so that flue gas is mixed with fresh air drawn into the primary air chamber from opening 180 through dampers 128(*a*) and/or 128(*b*). Flue gas at a temperature of less than about 700 degrees F. and containing, for example, about 2% $O_2$ is drawn from the furnace through passageway 176 by the inspirating effect of fuel gas passing through venturi portion 119 of burner tube 112. Primary air and flue gas are mixed in primary air chamber 126, which is prior to the zone of combustion. By drawing flue gas from the exhaust stream rather than directly from the furnace box adjacent the burner flame a lower temperature flue gas results, thereby substantially increasing the effectiveness of the flue gas to lower flame temperature which results in reduced $NO_x$ emission.

In operation, a fuel orifice 111, which may be located within gas spud 124, discharges fuel into burner tube 112, where it mixes with primary air, recirculated flue-gas or mixtures thereof. The mixture of fuel gas, recirculated flue gas, and primary air then discharges from burner tip 120. The mixture in the venturi portion 119 of burner tube 112 is maintained below the fuel-rich flammability limit; i.e. there is insufficient air in the venturi to support combustion. Secondary air is added to provide the remainder of the air required for combustion. The majority of the secondary air is added a finite distance away from the burner tip 120.

In addition to the use of flue gas as a diluent, another technique to achieve lower flame temperature through dilution is through the use of steam injection, which also advantageously increases the motive force available for inducing external FGR, when injected into the primary air chamber upstream of the venturi 119 of the burner tube 112. For $NO_x$ reduction purposes, alone, steam can also be injected into the secondary air chamber. Preferably, steam may be injected upstream of the venturi through injection tube 184.

It will also be understood that the teachings described herein also have utility in traditional raw gas burners and raw gas burners having a pre-mix burner configuration.

Although the invention has been described with reference to particular means, materials and embodiments, it is to be understood that the invention is not limited to the particulars disclosed and extends to all equivalents within the scope of the following claims.

What is claimed is:

1. A system for reducing $NO_x$ emissions in the combustion of fuel comprising:

(a) a furnace having at least one burner, said at least one burner comprising:

(i) a primary air chamber;

(ii) a burner tube including a downstream end, an upstream end in fluid communication with said primary air chamber for receiving air, flue gas or mixtures thereof and fuel, a venturi portion positioned between said downstream end and said upstream end, and a burner tip mounted on the downstream end of said burner tube for combusting fuel downstream of said burner tip; and (iii) a fuel orifice located adjacent the upstream end of said burner tube for introducing fuel into said burner tube;

(b) a source of flue gas, said source positioned so as to enable the flue gas to achieve a temperature of less than 2000° F.;

(c) at least one passageway for conducting flue gas from said source to said primary air chamber; and (d) inspirating means positioned within said at least one burner, said inspirating means including said venturi portion effective for drawing flue gas from said source, through said at least one passageway and said primary air chamber in response to an inspirating effect of uncombusted fuel exiting said fuel orifice, the uncombusted fuel flowing through said burner tube from its upstream end towards its downstream end, whereby the flue gas is mixed with air and fuel at said upstream end of said burner tube prior to the zone of combustion of the fuel.

2. The system of claim 1, wherein said fuel orifice is located within a gas spud.

3. The system of claim 1, wherein said at least one burner is a pre-mix burner.

4. The system of claim 1, wherein said at least one burner is a flat-flame burner.

5. The system of claim 1, wherein the fuel comprises fuel gas.

6. The system of claim 1, wherein said source is an exhaust of said furnace, said source positioned to enable flue gas having a temperature of less than 1000° F. to be drawn therefrom.

7. The system of claim 1, wherein said source is an exhaust of said furnace, said source positioned to enable flue gas having a temperature of less than 700° F. to be drawn therefrom.

8. The system of claim 6, wherein said at least one burner further comprises at least one air opening to said furnace, a secondary air chamber in fluid communication with said at least one air opening, and at least one adjustable damper opening into said secondary air chamber to restrict the amount of air entering into said secondary air chamber.

9. The system of claim 8, wherein said secondary air chamber is in fluid communication with a plurality of said air openings.

10. The system of claim 9, wherein said inspirating means is sufficient to draw an effective amount of flue gas from said source through said at least one passageway and into said primary chamber, without the aid of an external fan.

11. The system of claim 6, wherein said inspirating means is sufficient to draw an effective amount of flue gas from said source through said at least one passageway and into said primary chamber, without the aid of an external fan, so as to reduce $NO_x$.

12. The system of claim 1, wherein said inspirating means is sufficient to draw an effective amount of flue gas from said source through said at least one passageway and into said primary chamber, without the aid of an external fan.

13. The system of claim 12, further comprising means for injecting steam into the upstream end of said burner tube to increase motive force of said inspirating means and to cause a further reduction in $NO_x$ emissions.

14. The system of claim 1, further comprising means for injecting steam into said primary air chamber to increase motive force of said inspirating means and to cause a further reduction in $NO_x$ emissions.

15. The system of claim 1, wherein said burner further comprises a gas riser for mounting said fuel orifice thereon.

16. The system of claim 15, wherein said fuel orifice is located within a gas spud.

17. The system of claim 1, wherein said furnace comprises a plurality of burners.

18. The system of claim 17, wherein said plurality of burners share a single passageway for conducting flue gas from said source to said primary air chamber.

19. The system of claim 1, wherein the furnace is a steam-cracking furnace.

20. A method of reducing $NO_x$ emissions in a burner, said burner including a fuel orifice, said method comprising the steps of:

(a) providing a source of flue gas, the source positioned so as to enable the flue gas to achieve a temperature of less than 2000° F.;

(b) combining fuel and air, flue gas or mixtures thereof at a predetermined location adjacent a venturi;

(c) passing the combined fuel and air, flue gas or mixtures thereof through the venturi; and (d) combusting the fuel at a combustion zone downstream of the venturi;

whereby the inspirating effect of the uncombusted fuel exiting the fuel orifice and flowing through the venturi draws flue gas from the source through a passageway to the predetermined location.

21. The method of claim 20, wherein the fuel orifice is located within a gas spud.

22. The method of claim 20, wherein the at least one burner is a pre-mix burner.

23. The method of claim 20, wherein the at least one burner is a flat-flame burner.

24. The method of claim 20, wherein the fuel comprises fuel gas.

25. The method of claim 20, further comprising adjustably dampening flow of air to the primary air chamber.

26. The method of claim 20, further comprising adjustably dampening flow of air to the secondary air chamber.

27. The method of claim 20, wherein the flue gas is drawn from an exhaust stream of the furnace.

28. The method of claim 25, wherein the flue gas is drawn from an exhaust stream of the furnace.

29. The method of claim 26, wherein the flue gas is drawn from an exhaust stream of the furnace.

30. The method of claim 29, wherein the burner is a flat-flame burner.

31. The method of claim 20, wherein the furnace is a steam cracking furnace.

32. The method of claim 27, wherein the furnace is a steam cracking furnace.

33. The method of claim 28, wherein the furnace is a steam cracking furnace.

34. The method of claim 20, wherein the furnace comprises a plurality of burners.

35. The method of claim 34, wherein the plurality of burners share a single passageway for conducting flue gas from said source to said primary air chamber.

36. The method of claim 20, wherein the at least one burner further comprises means for injecting steam into the upstream end of the venturi to increase the inspirating effect and to cause a further reduction in $NO_x$ emissions.

* * * * *